United States Patent [19]

Stoakes

[11] Patent Number: 4,707,959

[45] Date of Patent: Nov. 24, 1987

[54] STRUCTURAL ASSEMBLIES SUCH AS CURTAIN WALLING

[76] Inventor: Richard L. Stoakes, "Clouds" Northdown Road, Woldingham Surrey, England

[21] Appl. No.: 832,596

[22] Filed: Feb. 25, 1986

[30] Foreign Application Priority Data

Feb. 28, 1985 [GB] United Kingdom ..... 8505155

[51] Int. Cl.[4] ..... E04H 1/00

[52] U.S. Cl. ..... 52/235; 52/476; 52/772; 52/775

[58] Field of Search ..... 52/235, 489, 772, 775, 52/483, 476

[56] References Cited

U.S. PATENT DOCUMENTS

| | | | |
|---|---|---|---|
| 3,053,353 | 9/1962 | Miller | 52/772 X |
| 3,321,880 | 5/1967 | Ferrell et al. | 52/775 X |
| 3,846,951 | 11/1974 | Paull | 52/235 X |
| 3,940,897 | 3/1976 | Stoakes | 52/235 X |
| 4,031,680 | 6/1977 | Stoakes | 52/772 |
| 4,055,923 | 11/1977 | Biebuyck | 52/235 |
| 4,117,640 | 10/1978 | Vanderstar | 52/775 X |
| 4,418,506 | 12/1983 | Weber et al. | 52/235 X |
| 4,428,171 | 1/1984 | Harbin | 52/772 X |
| 4,453,355 | 6/1984 | Stoakes | 52/235 |
| 4,557,089 | 12/1985 | Breithaupt | 52/235 |

FOREIGN PATENT DOCUMENTS

| | | | |
|---|---|---|---|
| 2062090 | 9/1972 | Fed. Rep. of Germany | 52/772 |
| 961136 | 6/1964 | United Kingdom | 52/772 |
| 2127058 | 4/1984 | United Kingdom . | |

*Primary Examiner*—Carl D. Friedman

*Attorney, Agent, or Firm*—Hopgood, Calimafde, Kalil, Blaustein & Judlowe

[57] ABSTRACT

A curtain wall comprises a framework of elongate main frame members defining cells in which infill panels are clamped by auxiliary frame members secured to the front of the framework. The panels are sealed in the cells by gaskets on the frame members. To prevent the weight of unclamped panels from distorting the auxiliary members and their securing screws, they rest on support elements projecting forwardly from slots in the transverse main frame members at the bottoms of the cells. The elements may relieve the auxiliary members entirely, or may rest on them when they are secured. Alternatively the panels may rest on the auxiliary members which transmit their weight to the support elements. The support elements and/or further locating elements can act to align the main and auxiliary members and guide the screws during construction.

14 Claims, 4 Drawing Figures

STRUCTURAL ASSEMBLIES SUCH AS CURTAIN WALLING

BACKGROUND OF THE INVENTION

This invention relates to structural assemblies for buildings and it is particularly concerned with structural assemblies such as curtain walling in which a number of smaller area panes or panels (referred to hereinafter simply as "panels") are mounted in a frame structure that is not a part of the main load-bearing structure of the building.

In my earlier United Kingdom Pat. No. 1,459,401 (corresponding to U.S. Pat. No. Re. 30,432), there is described such a structural assembly in which a metal framework forms a series of cells for individual infill panels which are supported on the framework and secured by a series of metal T-section auxiliary frame members, a rear centre web of each T-section member slotting into a channel in the front face of an adjoining main frame member while the arms at the front of the T-section carry external sealing gaskets which overlie the front edges of the panels, these gaskets being sealingly clamped against the panel edges by the auxiliary members.

To erect the assembly, the panels must be inserted into their positions while the auxiliary members are only loosely attached to the frameowrk. This must be done before the securing screws between the auxiliary members and the main framework are tightened to clamp the sealing gaskets against the infill and to fix the auxiliary members and the infill securely. That is not an entirely satisfactory method because the infill panels have to be handled with particular care and skill if the only partially secured auxiliary members are not to be deflected or even distorted before they can be firmly fixed in position. This difficulty grows as the panels increase in thickness and weight and is therefore particularly significant if double-glazed panels are utilised.

Moreover, although the transfer of heat through a curtain wall having this known construction is limited by the arrangement of the sealing gaskets to cover the outer faces of the auxiliary members, so that the metal members are not directly exposed to external temperature extremes, there is nevertheless close contact over a large area between the web of the T-section and its mating channel in the main framework. This provides a substantial heat-conductive path bridging the infill panels even though the front faces of the auxiliary members have the sealing gaskets shielding them from the exterior.

SUMMARY OF THE INVENTION

According to the present invention, there is provided a structural assembly for a curtain wall or the like, comprising a series of elongate main frame members secured together to form a framework defining a plurality of cells or spaces in which infill panels are placed, and a series of auxiliary frame members which are arranged to be secured to the main frame members to retain the infill panels, and a series of support elements projecting forwardly from at least some of the transversely extending main frame members, said support elements being arranged to engage and support the infill panels at least temporarily during mounting of the panels prior to the auxiliary members being secured in place on the main frame members.

The auxiliary frame members, and in particular the horizontal members, can thereby be wholly or partially relieved of dead load, in particular the weight of the infill panels, while only loosely held and when finally secured. In such a construction it is not necessary to provide an extended interlocking web and channel connection between the auxiliary members and the main frame members. The auxiliary members may, for example, be spaced from the main frame members, or possibly be held abutted against the front faces of their respective main frame members by screws or other clamping elements at spaced intervals along the length of the frame members. This need result in only a very restricted heat conduction path between the main and auxiliary members, through the clamping elements interconnecting them, and through any faces in abutment the contact area of which may be limited to a relatively small magnitude. Moreover, the support elements themselves may be of a low thermal conductivity material, e.g. a plastics material.

Conveniently, the main frame members having the support elements may comprise channels or like recesses in their front faces in which the support elements are fixed to project forwards from the main frame members. The support elements may overlap rear portions of the auxiliary members, being then disposed over such rear portions when required to support a panel above them. There is preferably a gap between the support elements and the auxiliary members in their region of overlap to ensure that the panel support loads are not transferred to the auxiliary members.

Although by such means as this there is the advantage that the support elements bear the weight of the infill both during assembly and in the completed structural assembly, the auxiliary frame members having to resist only wind loads on the curtain wall, it is alternatively possible to arrange that in the completed structural assembly the weight of the infill is at least partly transmitted to the main frame members through the auxiliary frame members.

In a preferred construction, each main frame member and its associated auxiliary member has a respective channel portion arranged so that the two channel portions are directly opposed to each other and receive connecting elements such as screws which secure the auxiliary members to the main members. To insert the screws from the exterior, the channel in the auxiliary member is preferably narrower than the thread crest diameter but is counterbored at intervals to provide guidance holes for the screws. In the main member channel, preformed ribs can be provided along the length of its inner walls, e.g. the member being an extruded section comprising such ribs, which are arranged to act as portions of a screw thread to grip the securing screws driven through said guidance holes.

The opposed channels can be employed for preliminary attachment of the auxiliary members to the main members before the screws are driven in, e.g. by inserting closely fitting plates or blocks, preferably of plastics or other low thermal conductivity material, to connect the members together frictionally. For this purpose it is convenient to make the width of the main auxiliary member slot the same as the width of the main member slot as measured between the crests of the opposed series of ribs. Such plates or blocks can ensure that the auxiliary and main members are correctly aligned for the true axial location of the screws as they are subsequently driven in. This is particularly important if there is a gap between the main and auxiliary members, and it will usually be arranged that such a gap is present as a thermal break between the members. It is also possible to utilise the support elements to provide guides for the fixing screws of the auxiliary members, which can be helpful even when the vertical loads from the infill are always kept from the auxiliary members.

By way of example, the invention will be described in more detail with reference to the accompanying drawings.

DESCRIPTION OF THE PREFERRED EMBODIMENTS

Figure 1:
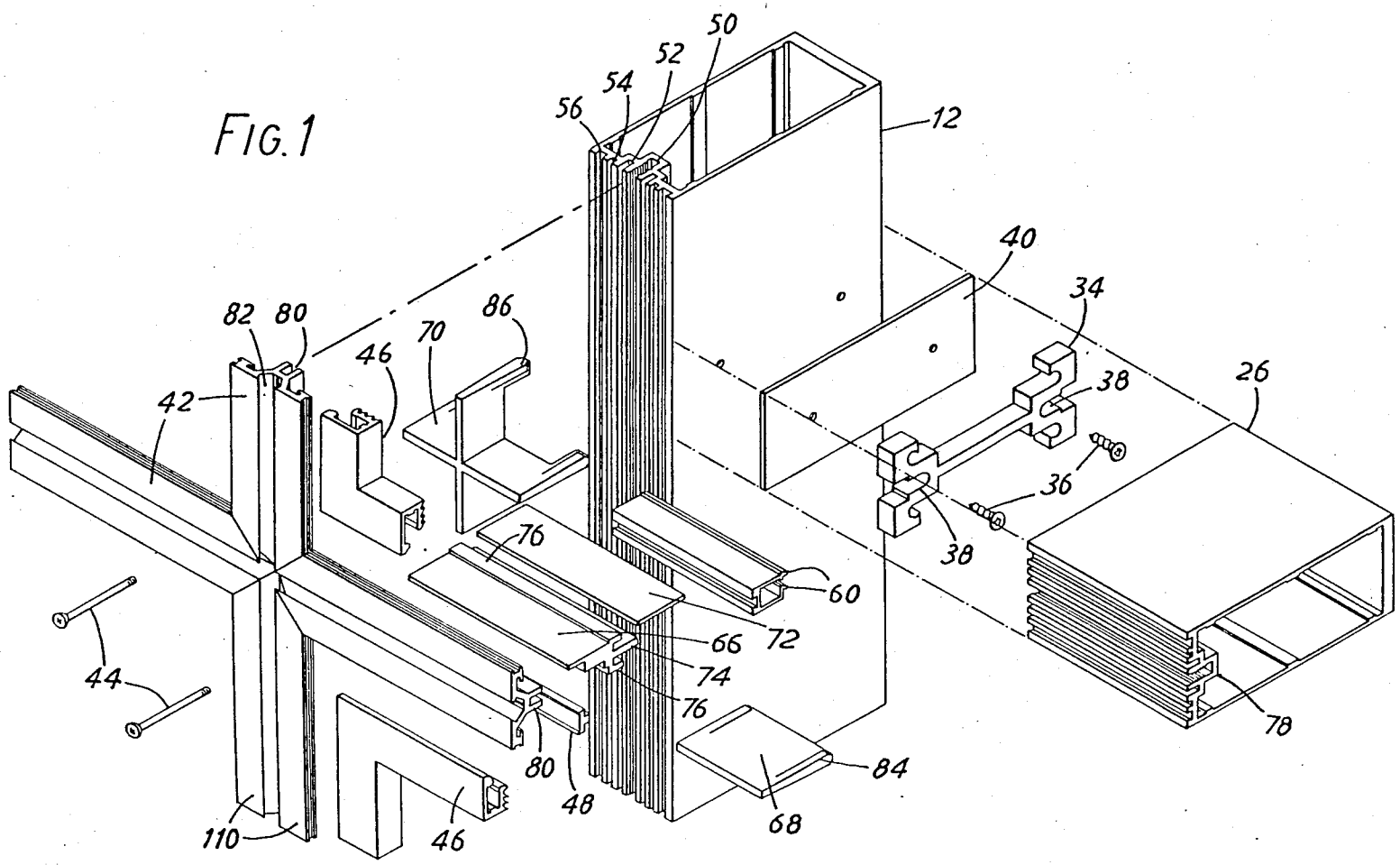
FIG. 1 is an exploded view of a part of a structural assembly according to the invention at a junction between mullion and transom members.
Figure 2:
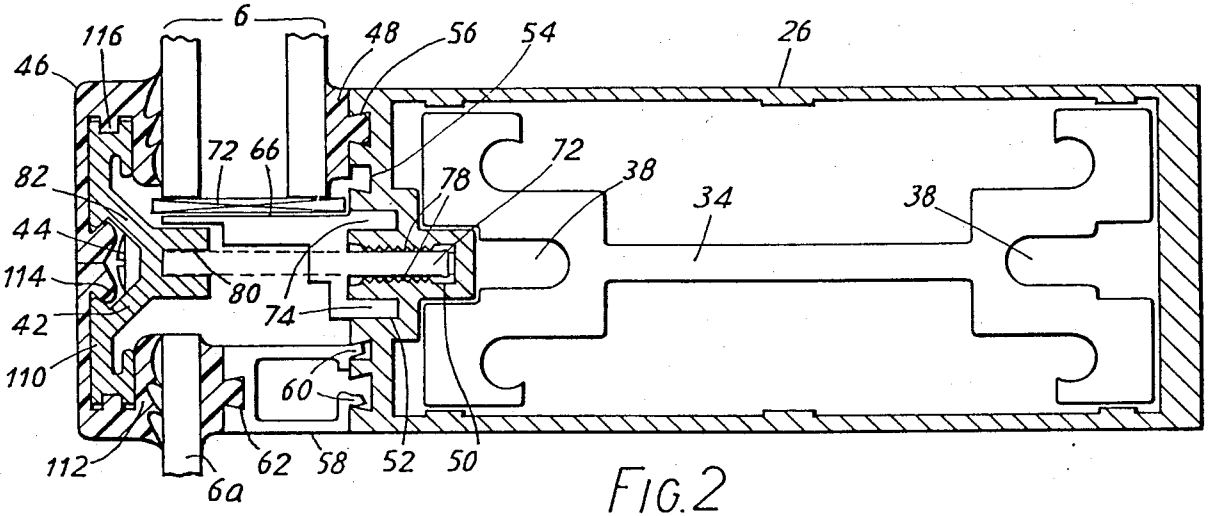
FIG. 2 is a vertical sectional view to a larger scale through a transom member of the assembly, illustrating a transition from double-glazing in the cell above the member to single-glazing below it.

Reference will be made first to FIGS. 1 and 2 of the drawings which show details of a curtain wall for a multi-storey building. The wall comprises a main framework, similar to that described in said United Kingdom Pat. No. 1,459,401, of extruded metal sections providing mullions 12, transoms 26 and top and bottom sills (not shown) that form rectangular cells enclosed by panels, double-glazed panels 6 and single glazed panels 6a being shown in FIG. 2. The framework is supported from the load-bearing structure of the building (not shown) by cleats to which the mullion members are bolted.

The top and bottom sill members of the framework are not illustrated but they may comprise box section members substantially the same as the mullion section members 12. These sill members may be secured directly to reveals of the building structure at the sides, top and bottom of the curtain wall.

The transom members 26 are mounted on the mullion members at their opposite ends by spigots 34 formed by short lengths of the same extruded section that provides reinforcing spigots 14 within these members. Self-tapping screws 36 pass through open slots 38 in the spigots 34 and into the side faces of the mullion box section, with interposed plastics pressure pads 40, to secure them in place. The spigots 34 have a sliding fit inside the transom box section and the transom members are slightly shorter than the lateral spacing between the mullion members on opposite sides of a cell to allow some sliding movement, e.g. for differential thermal expansion. Although not illustrated, vertical expansion movements can be accommodated similarly by arranging that the mullions are made up from lengths of sectional material that extend only the height of one or two storeys and that the joint between each pair of successive coaxial members is spaced from the top and bottom of the cell and is bridged by a reinforcing spigot fitting closely within the hollow mullion section and secured longitudinally, e.g. by the same bolts that fix the mullions to their cleats.

Figure 3:
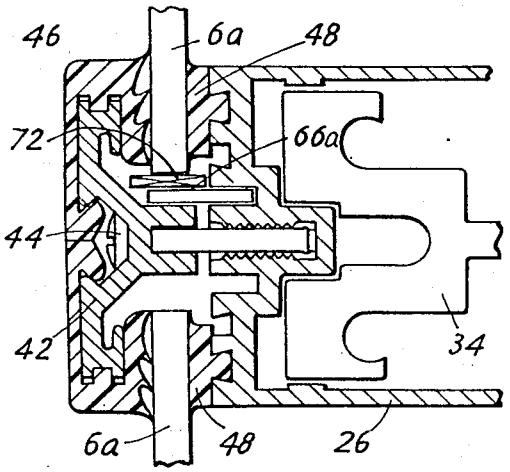
FIG. 3 is another vertical section illustrating how the invention may be applied to a single-glazed assembly.

Referring more particularly to FIGS. 1 to 3, the infill is clamped against the framework by auxiliary frame members 42 secured by screws 44 that sandwich the panels of the infill at their edges between outer and inner sealing gaskets 46, 48 so as to form a weathertight seal around each cell. The auxiliary members are disposed in front of the main framework and are secured to the frame members behind them by screws, as will be described in more detail below.

The mullion and transom members 12, 26 have the same symmetrical cross-section, comprising a closed box formation on the front face of which there is series of slots consisting of a central, relatively deep slot 50 flanked on each side by inner and outer pairs of shallower slots 52, 54, the slos having their laterally inner faces inclined so that the slots widen inwardly. In addition, between the outer slots and the edges of the front face are a pair of dovetail slots 56 in which the inner sealing gaskets 48 can be mounted. FIGS. 1 and 2 illustrate the transition between an upper cell with double-glazed panel 6 and a lower cell with single-glazed panel 6a; only the gasket 48 for the upper cell are mounted directly in the slots 56, there being a further extruded metal channel section used as a filler piece 58 to mount the gasket 46 for the lower cell, dovetail ribs 60 on the rear of the filler piece section fitting the slots 54 and 56 and a dovetail recess 62 in the front face holding the gasket 48.

Interposed between the main frame members and their associated auxiliary frame members, and exemplified in FIG. 1 between transom member 26 and its auxiliary frame member 42, are support elements in the form of rigid metal cantilever plates 66 and locating elements of two different forms, namely a plastics locating plate 68 and a plastics locating cross-piece 70 for the junction with the mullion member.

The cantilever plate 66 is one of two intended as sole support of the weight of the infill in the cell above it during assembly of the curtain wall and a plastics pressure pad 72 is placed between it and the bottom edge of the infill. The transom member provides a firmly engaging friction fit for the plates 66 which each comprise tongues 74, 76 having interference fits in the central slots 50 and the inner pair of slots 52 flanking it in the front of the transom member. The plate can be inserted until it abuts against the front face of the member and it is thus held rigidly with no risk of the load on the plate causing it to shift relative to the transom member. As illustrated in FIGS. 2 and 3, the plates 66 extend with a small clearance above their auxiliary frame member, which is thus isolated from the weight of the infill, although it is also possible to arrange that some load is transmitted by the plates through the auxiliary frame member when it is secure in place. If required, it is possible to mount further plates 66 with plastics pressure pads in the mullion members to locate the infill panels laterally.

The plastics plates 68 can be used as a locating means for the auxiliary members on the mullion members, and similarly on the transom members in the spaces between the support plates 66. The cruciform cross-piece 70 provides location for the auxiliary members at the junction of two adjacent transom members with their interposed mullion member. It will be understood that similar L-form or T-form cross-pieces can be provided at the junctions of the main frame members at the edges of the framework.

The securing screws 44 of the auxiliary members are engagaged in the central slots 50 of the main frame members which have series of ribs 78 on their opposed inner faces to engage the screw thread. To align with the thread, the two series of ribs on the opposed faces are offset from each other so that the crests on one face are directly opposite the troughs on the other. The central slot 80 in the rear limb of each auxiliary member is slightly narrower, its width being equal to the frame member slot width between the crests of the ribs 76 and at spaced points along its length each auxiliary member is drilled perpendicular to its front face and centrally to the width of the slots 80 to provide clearance holes for the shanks of the screws 44. The screws have flat countersunk heads which fit against the bevelled back face of the lobe-like recess 82 running along the auxiliary member front face, possibly with interposed non-metallic washers to reduce conduction of heat.

The plastics plates 68 and cross-pieces 70 are tight fits in the opposed central slots 50, 80 in the main and auxiliary members. Because of the different widths of the slots in the respective members, the plates 68 have thickened rear side portions 84 so that they are gripped firmly in the main frame member slots. Similarly, the cross-pieces 70 have thicker rear legs 86 for the same purpose.

In the first stage of erection of the curtain wall, the main framework is assembled and secured in place on the load-supporting structure of the building and the rear sealing gaskets 48 are fitted into their slots in the main frame members with the interposition of filler pieces 58 if needed. At the required positions on the frame members, the support elements 66 are inserted into the slots provided for them in the member front faces, and on the auxiliary frame members 42 the location elements 68, 70 are inserted in the slot 80.

The auxiliary frame members 42 are cut so that there are short mitered lengths (illustrated in FIG. 2) at each corner of a cell fitting closely together, and one or more longer lengths occupy each edge of the cell between these corner pieces, with a small gap being left in each case for expansion movements and the like. Initially, before the infill panel of each cell is added, only the lower corner lengths of the auxiliary frame members are mounted in place with the plastics cross-pieces 70 previously inserted and are loosely secured by their screws 44 to prevent detachment.

As each infill panel is put into position to rest on its support elements 66, at least those auxiliary frame members extending along its bottom edge and one side edge are loosely secured by their screws 44 to ensure the panel is retained in place. The remaining auxiliary members of that cell can then be placed in position with their location elements and their securing screws inserted but not tightened down.

Figure 4:
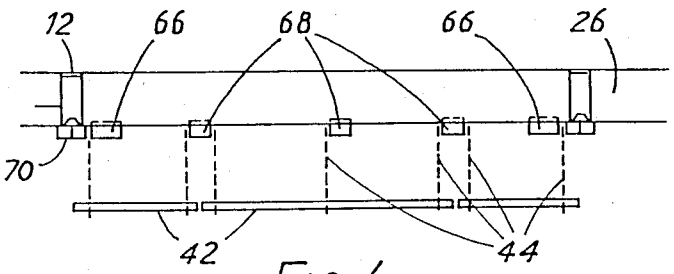
FIG. 4 illustrates schematically a distribution of support elements and auxiliary member attaching means along the length of a transom member.

In a preferred arrangement, as is indicated schematically in FIG. 4, two support elements 66 are provided for the bottom edge of a panel, these being positioned close to the mullions defining the lateral edges of the cell. The plastics location elements 68 may be set at intervals between the support elements, in particular to ensure alignment between adjacent lengths of auxiliary frame member 42. In addition, the support and location elements are so positioned that their lateral extremities are near the holes drilled in the auxiliary members for the securing screws 44. It is thereby ensured that there is close alignment between the auxiliary member and the central slot of the associated main frame member at each position at which a screw is being driven in. It is preferably arranged that the thread of each screw bears lightly on a side edge of an element, so that the screw axis is kept central of the main frame member slot 50, despite the considerable gap that may exist between the guidance hole in the auxiliary frame member and the slot 50.

The main gaskets are of an analogous form to that described in earlier patent United Kingdom Pat. No. 1,496,483 (corresponding to U.S. Pat. No. 4,016,695).

Thus, they are made in loop-form to extend unbroken around the periphery of a cell and the gasket section embraces a front flange 110 of the T-section auxiliary frame member to provide a rear sealing face 112, on which there is a series of ribs pressed against the adjoining margin of the infill, and an inner front edge projection 114 which is inserted into the front recess 82 of the auxiliary member, where both said edge portions of the opposed gaskets on the auxiliary member are gripped to hold the gaskets securely in place and to seal the auxiliary member from the exterior.

These loop-form gaskets are mounted on the auxiliary frame members while those members are still only loosely fixed, and there is therefore space for the free insertion of the ribbed portion 112 between the auxiliary member flange and the infill. Initially, the gaskets are held only loosely on the auxiliary member flanges, the front recess of the members being left clear so that the securing screws 44 can be driven home fully. Tightening the securing screws brings the rear face 112 of the gasket into full sealing engagement with the opposed face of the infill.

The free portions of the gasket can now be laid against the front faces of the auxiliary members and their inner edge projections 114 can be forced into the front recess, where they are resiliently compressed by the interference fit between them. It is of course also possible to provide the gaskets with inner edge projections that are locked in place by a separate zipper strip.

In the lateral outer edge of each auxiliary member flange there is a recess 116 occupied by a corresponding projection on the inner face of the sealing gasket. This is able to ensure that the pressure of the panel on the rear of the gasket does not force the outer front edge of the gasket away from the auxiliary member and so preserves a substantially flat, neat appearance when the assembly has been completed.

In the single-glazed construction shown in Fig.2, because of the smaller bending loads imposed by the panels, the support elements are provided by simple rectangular metal plates 66a cantilevered from the upper of the inner pair of slots 52, with plastics pressure pads 72 between the plates and the panels as already described. The simpler form of plate 66a can also be used in the mullions of double-glazed constructions to locate the panels laterally, instead of the plates 66.

It is also possible to arrange that the panels rest upon the rear limbs of auxiliary members, especially if these rear limbs are intended to be butted against the main frame members, although the advantages obtained by isolating these auxiliary members from the weight of the panels are lost. Where the weight is transmitted through the illustrated form of auxiliary member, plate-like support elements will engage in the rear central slot of the auxiliary member and in the central slot of the main member; if there is little or no gap between the auxiliary and main frame members these support elements may be made of plastics without any significant deflection of the auxiliary members occurring. If an auxiliary member has a panel resting on it a packing element, e.g. of plastics, should be interposed to limit heat conduction.

What is claimed is:

1. A structural assembly comprising a series of elongate main frame members forming a wall framework, said members comprising a series of essentially vertically extending members and a series of essentially transversely extending members that jointly define a plurality of cells in the framework, respective panels infilling said cells, a series of auxiliary frame members extending forwardly of the main frame members for retaining the infill panels in their cells, securing screws extending through said auxiliary members and into said vertically and transversely extending main members to secure auxiliary members to the main members, means carried by said auxiliary frame members for sealing the infill panels in their cells, said sealing means being pressed into sealing contact with the infill panels by the tightening of the securing screws, a series of discrete support elements for said panels and means holding said support elements projecting forwardly from at least some of the transversely extending main frame members for supporting the infill panels at least temporarily prior to securing the auxiliary frame members finally to the main frame members.

2. A structural assembly according to claim 1, wherein the support elements are maintained out of bearing contact with the auxiliary members, whereby to support the weight of the infill panels independently of the auxiliary members.

3. A structural assembly according to claim 1, wherein the support elements have rearward and forward portions, said portions bearing respectively on said main frame members and on auxiliary frame members secured thereto.

4. A structural assembly according to claim 1, wherein the finally secured aubiliary frame members are spaced forwardly from the main frame members.

5. A structural assembly according to claim 1, wherein said transversely extending main frame members provided with support elements comprise front recesses in which the support elements are fixed to project forwardly from the main frame members.

6. A structural assembly according to claim 5, wherein the front faces of the traversely extending main frame members carrying support elements comprise a plurality of vertically spaced longitudinal recesses, and the support elements comprise a plurality of vertically spaced tongues projecting rearwardly to be received in said recesses.

7. A strucural assembly according to claim 1, further comprising locating elements between at least some of the main and auxiliary frame members, the locating elements engaging the frame members to align the auxiliary members with the main members before the auxiliary members are finally secured to the main members.

8. A structural assembly according to claim 1, wherein at least some of said main frame members have a slotted front face, a longitudinal slot in said face being forwardly open, and said auxiliary frame members have a rearwardly open longitudinal slot, said longitudinal slots on the auxiliary and main frame members being directly opposed, and securing screws extending between said main and auxiliarymember slots for securing the auxiliary frame members to the main frame members.

9. A structural assembly comprising a series of elongate main frame members forming a wall framework, a plurality of cells being defined in the framework by said members, respective panels infilling said cells, a series of auxiliary frame members secured to and extending forwardly of the main frame members for retaining the infill panels in their cells, means carried by said auxiliary frame members for sealing the infill panels in their cells, a series of discrete support elements for said panels, and means holding said support elements projecting forwardly from at least some of the transversely extending main frame members for supporting the infill panels at least temporarily prior to securing the auxiliary frame members finally to the main frame members, the auxiliary frame members being secured to the main frame members from which the support elements project have a contact surface on which said panels rest and through which at least part of the weight of the panels is transmitted to said support elements.

10. A structural assembly comprising a series of elongate main frame members forming a wall framework, a plurality of cells being defined in the framework by said members, respective panels infilling said cells, a series of auxiliary frame members secured to and extending forwardly of the main frame members for retaining the infill panels in their cells, means for sealing the infill panels in their cells, support elements projecting forwardly from at least some of the transversely extending main frame members for supporting the infill panels at least temporarily prior to securing the auxiliary frame members finally to the main frame members, locating elements between at least some of the main and auxiliary frame members, the locating elements engaging the frame members to align the auxiliary members with the main members before the auxiliary members are finally secured to the main members, mutually transversely directed main frame members defining corners of said cells and said locating elements, at least at some of the cell corners, comprise mutually transverse planar portions for engagement with the frame members extending to the regions of said corners.

11. A structural assembly comprising a series of elongate main frame members forming a wall framework, a plurality of cells being defined in the framework by said members, respective panels infilling said cells, a series of auxiliary frame members secured to and extending forwardly of the main frame members for retaining the infill panels in their cells, at least some of the main frame members comprising a slotted front face, a longitudinal slot in said face being forwardly open, and said auxiliary frame members comprising a rearwardly open longitudinal slot, said longitudinal slots in the auxiliary and main frame members being directly opposed, securing screws extending between said slots for securing the auxiliary frame members to the main frame members, means for sealing the infill panels in their cells, and support elements projecting forwardly from at least some of the transversely extending main frame members for supporting the infill panels at least temporarily prior to tightening said screws to secure the auxiliary frame members finally to the main frame members, and locating elements between at least some of the main and auxiliary frame members provided with slots and engaging the slots to align said main and auxiliary members, said locating elements being engaged by the securing screws for providing guidance for said screws.

12. A structural assembly comprising a series of elongate main frame members forming a wall framework, a plurality of cells being defined in the framework by said members, respective panels infilling said cells, a series of auxiliary frame members secured to and extending forwardly of the main frame members for retaining the infill panels in their cells, at least some of the main frame members comprising a slotted front face, a longitudinal slot in said face being forwardly open, and said auxiliary frame members comprising a reawardly open longitudinal slot, said longitudinal slots in the auxiliary and main frame members being directly opposed, securing screws extending between said slots for securing the auxiliary frame members to the main frame members, means for sealing the infill panels in their cells, and support elements projecting forwardly from at least some of the transversely extending main frame members for supporting the infill panels at least temporarily prior to tightening said screws to secure the auxiliary frame members finally to the main frame members, the support elements being engaged by the securing screws and providing guidance for said screws between the main and auxiliary frame members.

13. A structural assembly comprising a series of elongate main frame members forming a wall framework, a plurality of cells being defined in the framework by said members in which mutually transversely directed members define corners of said cells, respective panels infilling said cells, a series of auxiliary frame members secured to and extending forwardly of the main frame members for retaining the infill panels in their cells, means for sealing the infill panels in their cells, support elements projecting forwardly from at least some of the transversely extending main frame members for supporting the infill panels at least temporarily prior to securing the auxiliary frame members finally to the main frame members, and locating elements between at least some of the main and auxiliary frame members, at least some of the cell corners comprising mutually transverse planar portions for engagement with the frame members extending to the regions of said corners, the locating elements engaging the frame members to align the auxiliary members with the main frame members before the auxiliary members are finally secured to the main frame members.

14. A structural assembly comprising a series of elongate main frame members forming a wall framework, a plurality of cells being defined in the framework by said members, respective panels infilling said cells, a series of auxiliary frame members secured to and extending forwardly of the main frame members for retaining the infill panels in their cells, at least some of the main frame members comprising a slotted front face, a longitudinal slot in said face being forwardly open, and said auxiliary frame members comprising a rearwardly open longitudinal slot, said longitudinal slots in the auxiliary and main frame members being directly opposed, securing screws extending between said slots for securing the auxiliary frame members to the main frame members, means for sealing the infill panels in their cells, and support elements projecting forwardly from at least some of the transversely extending main frame members for supporting the infill panels at least temporarily prior to tightening said screws to secure the auxiliary frame members finally to the main frame members, and locating elements between at least some of the main and auxiliary frame members, the locating elements engaging the frame members to align the auxiliary members with the main frame members before the auxiliary members are finally secured to the main frame members.

* * * * *